United States Patent [19]

Makino et al.

[11] 4,258,769

[45] Mar. 31, 1981

[54] PNEUMATIC TIRES FOR HEAVY VEHICLES

[75] Inventors: Shigeo Makino, Tokorozawa; Shigeo Watanabe, Kokubunji; Toshiyuki Sogi, Higashi-Yamato, all of Japan

[73] Assignee: Bridgestone Tire Company Limited, Tokyo, Japan

[21] Appl. No.: 702,312

[22] Filed: Jul. 2, 1976

[30] Foreign Application Priority Data

Mar. 15, 1976 [JP] Japan ..... 51-27986

[51] Int. Cl.[3] ..... B60C 11/04; B60C 11/12

[52] U.S. Cl. ..... 152/209 R; D12/149

[58] Field of Search ..... 152/209 R, 209 D, 209 A; D12/149, 150, 151

[56] References Cited

U.S. PATENT DOCUMENTS

| | | | |
|---|---|---|---|
| 2,079,091 | 5/1937 | Walsh | 152/209 R |
| 3,789,898 | 2/1974 | Montagne | 152/209 R |
| 3,831,654 | 8/1974 | Boileau | 152/209 R |
| 3,897,813 | 8/1975 | Verdier | 152/209 R |

FOREIGN PATENT DOCUMENTS

| | | | |
|---|---|---|---|
| 1387427 | 12/1964 | France | 152/209 R |

*Primary Examiner*—F. J. Bartuska

*Attorney, Agent, or Firm*—Sughrue, Rothwell, Mion, Zinn and Macpeak

[57] ABSTRACT

A radial tire provided with a tread pattern suitable for travel on paved roads at a high speed is disclosed.

The tread pattern is of a block-rib type which is constructed to satisfy the following conditions, i.e.

(1) $W_1=(5\text{–}9\%)$ TW (2) $W_2=(0.5\text{–}2.5\%)$ TW (3) 60% BW$\geqq$A and A$\geqq$20% TW (4) $B_2=(1.0\text{–}2.0)\ B_1$ where $W_1$ is a width of a wide circumferential groove, TW is a tread width, $W_2$ is a width of a narrow circumferential groove, BW is an effective width of a belt, A is a width of a tread center portion, $B_1$ is a tread side portion facing the tread center portion and $B_2$ is a tread side portion facing two shoulder portions.

11 Claims, 6 Drawing Figures

PNEUMATIC TIRES FOR HEAVY VEHICLES

This invention relates to pneumatic tires for heavy vehicles such as trucks, buses and the like and more particularly to a radial tire provided with a tread pattern suitable for travel on paved roads at a high speed.

In general, tread patterns of tires are classified into a lug type, rib type, block type, rib-lug type, lug-block type, and block-rib type. These tread patterns are applied to various kinds of tires so as to effectively utilize the respective features of each pattern.

A rib type tire, for example, is provided with a plurality of ribs continuously extending circumferentially of the tire and spaced apart from each other. This construction permits the rib type tire to be applied to a tire for travel on paved roads at a high speed.

The conventional rib type pattern applied to a radial tire for heavy vehicles has the disadvantage that the tire tread portion becomes unevenly worn to shorten the life of tire. It has been well known that the radial tire has excellent wear resistance as a result of its constructional feature. The radial tire, however, is provided at its crown portion with a circumferential belt layer having a high rigidity. As a result, the radial tire has a tendency to wear unevenly. This uneven wear becomes conspicuous when material of the tire is improved for the purpose of improving its wear resistant property.

There are various kinds of abnormal wear associated with tires. Wear which causes indentations or steps to be produced across the boundary of a substantially transverse groove which defines a tread pattern, is called heel and toe wear. Wear which causes generation of steps extending transversely in the cross-sectional direction of the tire and particularly causes the tread rubber facing both the shoulder portions to wear more readily than the tread rubber facing the center portion, which is called uneven shoulder wear. Wear which abnormally occurs at that portion of circumferential ribs defined by a circumferential groove which is adjacent to the circumferential groove, is is called railway wear.

Many attempts have been made to avoid uneven wear of the tire, but hitherto none has led to fully satisfactory results which can effectively avoid all kinds of uneven wear of the tire.

An object of the invention, therefore, is to provide a radial tire for heavy vehicles such as trucks, buses and the like, which can prevent occurrence of all kinds of uneven wear of the tire or can prevent it from occurring.

In order to attain such an object, the radial tire for heavy vehicles according to the invention makes use of a block-rib type tread pattern instead of a rib type tread pattern which has been deemed optimum for the conventional radial tire for heavy vehicles on travel on good roads at a high speed. The block-rib type tread pattern per se has been well known and does not constitute the essential feature of the invention. The important significance of the invention lies in the use of the block-rib type tread pattern as the tread pattern of the radial tire for heavy vehicles for travel on good roads at a high speed.

A feature of the invention is the provision of a pneumatic tire for heavy vehicles comprising a block-rib type tread provided at its center portion with a block pattern and at its two side portions with a rib pattern. A radial carcass, and a belt interposed between said tread and said carcass are utilized with the, tread having a pair of wide zigzag or wavy grooves extending circumferentially of said tread and substantially V-shaped in cross-section. The grooves divide the tread into a center portion and two side portions, preferably each said wide grooves having a width at the surface of said tread 5% to 9% of the width of said tread, said tread center portion having a width at the surface of said tread at least 20% of the width of said tread and at most 60% of the effective width of said belt. The two side portions have narrow zigzag or wavy grooves extending circumferentially of the two side portions and dividing said each two side portion into a region facing the center portion and a region facing the two shoulder portions. Also, at least said region facing the two shoulder portions maintains the circumferential continuity thereof, preferably each said narrow circumferential grooves having a width at the surface of said tread 0.5% to 2.5% of the width of said tread, and said region facing the two shoulder portions having a width which is 1.0 to 2.0 times, preferably 1.2 to 1.8 times, the width of the region facing the center portion.

The invention will now be described in greater detail with reference to the accompanying drawings; wherein.

Figure 1:
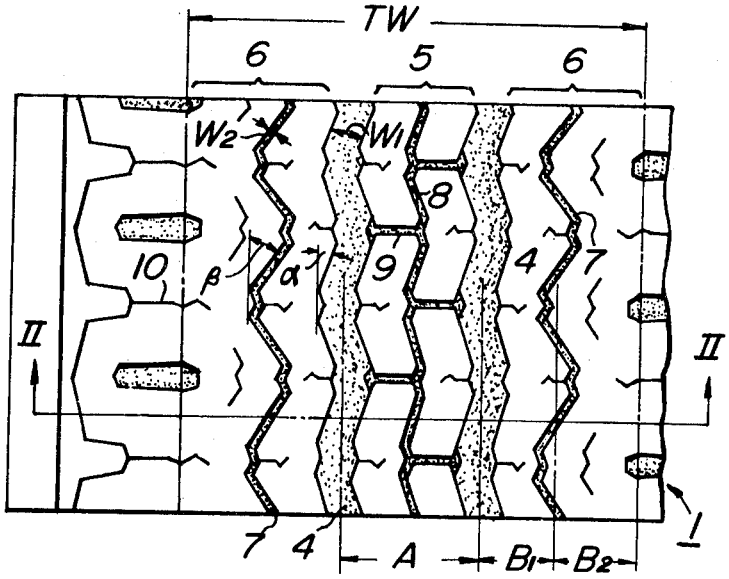
FIG. 1 is a plan view of a portion of a tire tread embodying the present invention.
Figure 2:
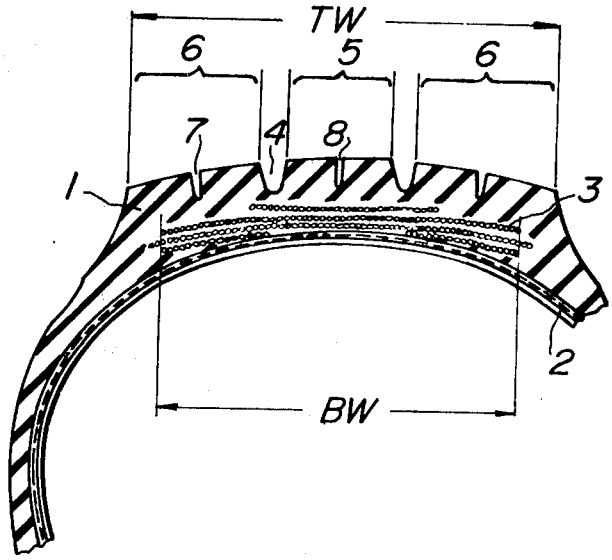
FIG. 2 is a cross-sectional view taken along line II—II of FIG. 1.

Referring to FIGS. 1 and 2, a pneumatic tire shown comprises a tread 1, a radially arranged carcass 2 and a belt 3 interposed between the tread 1 and the carcass 2. The tread 1 is provided with a pair of wide, substantially V-shaped grooves 4, 4 in cross-section of zigzag or wavy configuration extending circumferentially of the tire. The wide circumferential grooves 4, 4 divide the tread 1 into a center portion 5 which forms a block pattern and two side portions 6, 6 which form rib patterns. Each the wide circumferential grooves 4, 4 has preferably a width $W_1$ at the surface of the tread 5% to 9% of the width TW of the tread 1. The rectilinear section of the zigzag configuration of the wide circumferential grooves 4, 4 is preferably inclined from its circumferential direction by an angle in the range of 8° to 28°.

The center portion 5 defined by the wide circumferential grooves 4, 4 has a width A which is at least 20% of the tread width TW and at most 60% of an effective belt width BW. The term effective belt width BW shall be understood to include a width of overlapped portions of two cord layers whose cords are inclined 10° to 35° with respect to the equatorial line and extended in opposite directions from each other, but exclude a width of overlapped portions of two cord layers whose cords are inclined a considerably large angle with respect to the equatorial line and extended in opposite directions from each other and a width of overlapped portions of two cord layers whose cords are inclined 10° to 35° with respect to the equatorial line and extended in opposite directions from each other, but the width being extremely narrow.

The block pattern formed on the tread center portion 5 is divided into at least two rows of block groups by means of a narrow circumferential groove 8. Each row of block group is divided into respective blocks by means of a narrow groove 9 extending transversely of the tire. The width of the narrow circumferential groove 8 and the narrow transverse groove 9 is 0.5% to 2.5%, preferably 1% to 2% of the tread width TW. In addition, the width of the narrow circumferential groove 8 is preferably 100% to 150% of the width of the narrow transverse groove 9. The depth of these grooves is 60% to 120%, preferably 70% to 100% of the depth of the wide circumferential grooves 4, 4.

The two side portions 6, 6 of the tread are divided into a region facing the center portion and a region facing the two shoulder portions by means of a narrow zigzag or wavy circumferential grooves 7. At least the region of facing the two shoulder portions provides rib patterns which do not interrupt their circumferential continuity. The width $W_2$ of these narrow circumferential grooves 7 is preferably 0.5% to 2.5% of the tread width TW. The width $B_2$ of the region facing the two shoulder portions is 1.0 to 2.0, preferably 1.2 to 1.8 times wider than the width $B_1$ of the region facing the center portion.

In addition, the inclined angle $\beta$ of the rectilinear section of the narrow zigzag or wavy circumferential grooves 7 is made larger than the inclined angle $\alpha$ of the rectilinear section of the wide circumferential grooves 4 by 10° to 40°. If the difference between these inclined angles $\beta$ and $\alpha$ is smaller than 10°, these grooves become substantially parallel with each other, and as a result, the tread has a tendency to provide the uneven shoulder wear starting from the narrow circumferential groove 7. On the contrary, if the difference between these inclined angles $\beta$ and $\alpha$ is larger than 40°, the heel and toe wear becomes excessive. It is preferable to locate the narrow zigzag or wavy circumferential grooves 7 within a range of the effective belt width BW. It is not desirous to locate the narrow zigzag or wavy circumferential grooves 7 near the edges of the shoulder portions beyond the effective belt width BW. If desired the rib pattern may be provided with a plurality of narrow transverse slits 10 for the decoration purposes. The length of the narrow slits 10, however, should be at most 15% of the tread width TW since the narrow slits 10 having a length larger than 15% of the tread width TW would interrupt the circumferential continuity of the rib pattern.

Figure 3:
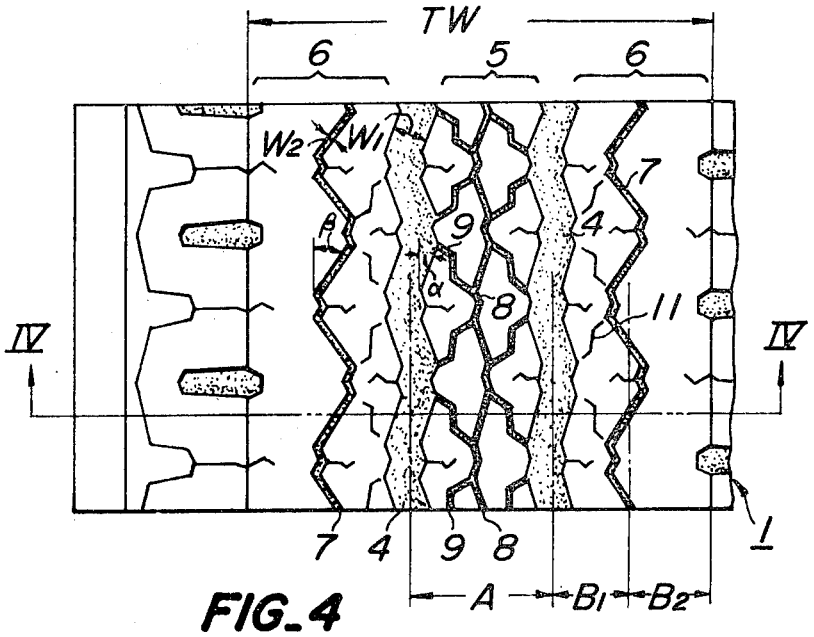
FIG. 3 is a plan view of a modified form of tire tread embodying the present invention.
Figure 4:
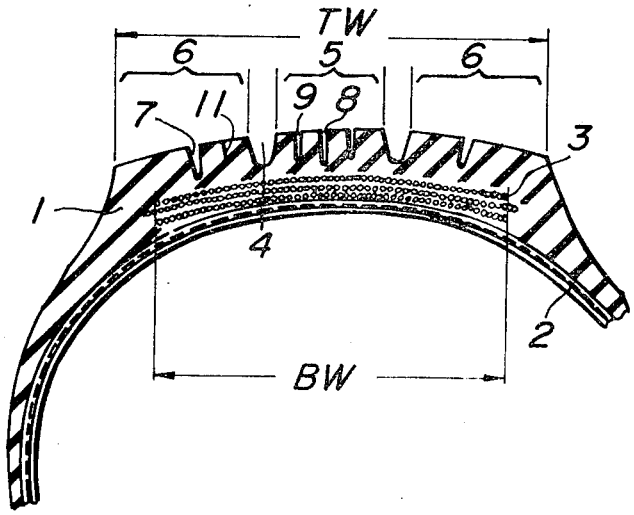
FIG. 4 is a cross-sectional view taken along line IV—IV of FIG. 3.

In the modified form of tread disclosed in FIGS. 3 and 4, the narrow transverse grooves 9 provided in the tread center portion 5 defined by the two wide circumferential grooves 4, 4 are made zigzag in shape, the two side portions 6, 6 divided by the narrow circumferential grooves 7 are provided at their regions facing the center portion with a plurality of narrow slits 11; and the arrangement of the belt 3 between the tread 1 and the carcass 3 is modified.

Figure 5:
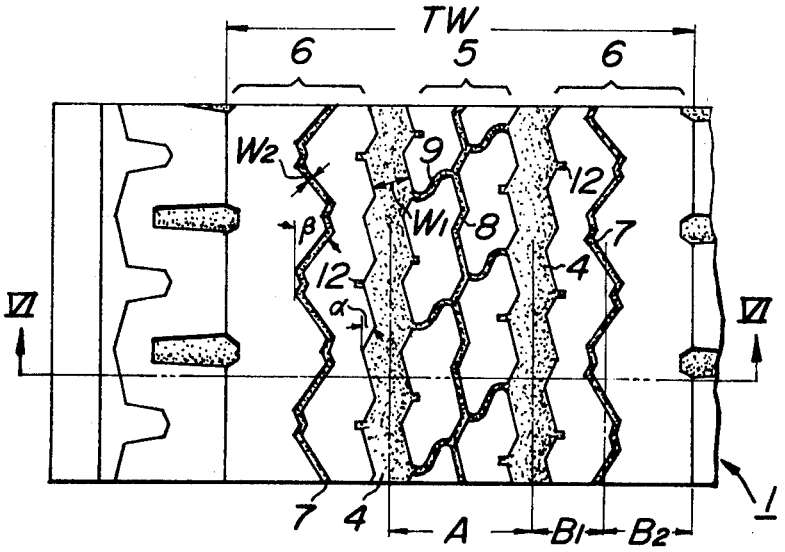
FIG. 5 is a plan view of another modified form of tire tread embodying the present invention.
Figure 6:
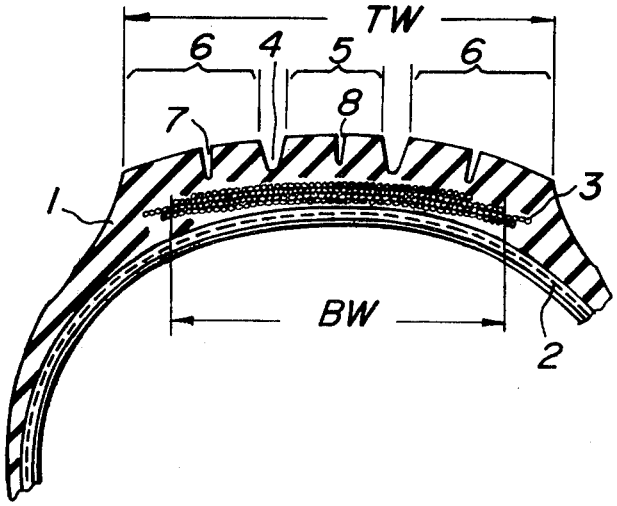
FIG. 6 is a cross-sectional view taken along line VI—VI of FIG. 5.

In the another modified form of tread disclosed in FIGS. 5 and 6, the wide zigzag circumferential grooves 4, 4 are provided at their opposed alternate curved points with narrow slits 12.

As explained hereinbefore, the use of the block pattern provided in the center portion 5 of the tire tread 1 ensures a decrease in difference between the rigidity of the center portion 5 and the rigidity of the two side portions 6 and provides the important advantage that the configuration of tread which makes contact with the roads becomes considerably improved so as to prevent occurrence of the uneven shoulder wear. In addition, the use of the region of the block pattern at the center portion 5 having a width which is at most 60% of the effective belt width BW permits the wide circumferential grooves 4 to be located at a position away from the two shoulder portions of the tire so that there is no risk of the rigidity of the rib pattern provided on the two side portions 6 of the tread being decreased. Hence it is possible to obviate the disadvantage of uneven shoulder wear starting from the wide circumferential grooves 4.

In general, the railway wear does not occur at the center portion of the tread, but is easily occurs at that portion of the tire tread which is faced to the shoulder portion. As a result, if the width of the tread center region is narrower 20% of the tread width TW, the rigidity of the tread center region becomes considerably decreased and will initiate the occurrence of railway wear. In accordance with the invention, the width of the block pattern region at the center portion 5 of the tire tread 1 is made at least 20% of the tread width TW, so that it is possible to refrain railway wear from occurring.

In addition, the two side portions 6, 6 of the tire tread 1 are subdivided into the region facing the center portion and the region facing the shoulder portion, the circumferential continuity of at least the region facing the two shoulder portions is maintained, and the width of the region facing the two shoulder portion is made 1.0 to 2.0 times, preferably 1.2 to 1.8 times the width of the region facing the center portion. The use of the measures described contributes to the overall decrease of uneven wear. If a ratio of the width of the region facing the center portion to the width of the region facing the two shoulder portions becomes smaller than 1:1, the uneven shoulder wear at the region facing the shoulder portion becomes conspicuously large so that the relative rigidity of these two regions should be at least 1:1. Conversely, if the rigidity ratio between these two regions exceeds 1:2, the relative rigidity of the region facing the center portion becomes small, and as a result, railway wear occurs along the wide circumferential groove 4 adjoining the region facing the center portion.

As explained hereinbefore, the radial tire for heavy vehicles suitable for travel at a high speed according to the invention can refrain various kinds of uneven wear from occuring. The radial tire according to the invention having a tire size of 1000 R 20, the internal pressure of 7.25 Kg/cm$^2$, tire load of 2700 Kg/one tire, in tests over a distance 12,000 Km at a speed of 70 Km/hr on good roads composed of 40% of general roads and 60% of high speed roads, has improved railway wear by about 30% of the railway wear of the conventional tire and has prevented uneven shoulder wear and refrained the uneven wear from becoming occurred.

What is claimed is:

1. A pneumatic tire for heavy vehicles comprising: a block-rib type tread provided at its center portion with a block pattern and at its two side portions provided with a rib pattern, a radial carcass, and a belt interposed between said tread and said carcass and having a high rigidity in the circumferential direction of the tire, said tread having a pair of wide zigzag or wavy grooves extending circumferentially of said tread and substantially V-shaped in cross-section, said grooves dividing said tread into a center portion and two side portions, each of said wide grooves having a width at the surface of said tread in the range of 5% to 9% of the width of said tread, said tread center portion having a width at the surface of said tread ranging from 20% of the width of said tread to 60% of the effective width of said belt, said two side portions having narrow zigzag or wavy grooves extending circumferentially of said two side portions and dividing said two portions into a region facing the center portion and a region facing the two shoulder portions, at least said region facing the two shoulder portions maintaining the circumferential continuity thereof, said center having narrow grooves defining a block pattern having a width at the surface of said tread of 0.5% to 2.5% of the width of said tread, and said region facing the two shoulder portions having a width which is 1.0 to 2.0 times the width of the region facing the center portion, said grooves defining said block pattern composed of a narrow circumferential groove and a narrow transverse groove and said block pattern formed on the tread center portion is divided into at least two rows of block groups by means of said narrow circumferential groove and each row of block groups is divided into respective blocks by means of said narrow transverse groove.

2. A pneumatic tire according to claim 1 wherein said region facing the two shoulder portions has a width which is 1.2 to 1.8 times the width of the region facing the center portion.

3. A pneumatic tire according to claim 1 wherein the rectilinear section of the zigzag configuration of said wide circumferential grooves is inclined from its circumferential direction by 8° to 28°.

4. A pneumatic tire according to claim 1 wherein the inclined angle of the rectilinear section of the zigzag configuration of said narrow grooves is larger than the inclined angle of the rectilinear section of the wide circumferential grooves by 10° to 40° and the width of said narrow grooves is 0.5% to 2.5%, preferably 1% to 2% of tread width.

5. A pneumatic tire according to claim 1 wherein the width of said narrow circumferential groove is 100% to 150% of the width of said narrow transverse groove.

6. A pneumatic tire according to claim 1 wherein the depth of both said narrow circumferential groove and said narrow transverse groove is 60% to 120%, preferably 70% to 100% of the depth of said wide circumferential grooves.

7. A pneumatic tire according to claim 1 wherein said narrow zigzag circumferential grooves are located within a range of the effective belt width.

8. A pneumatic tire according to claim 1 wherein said rib pattern is provided with a plurality of narrow transverse slits each having a length of at most 15% of said tread width.

9. A pneumatic tire according to claim 1 wherein said narrow transverse grooves are made zigzag in shape.

10. A pneumatic tire according to claim 1 wherein said region of said two side portions facing the center portion is provided with a plurality of narrow slits.

11. A pneumatic tire according to claim 1 wherein said wide zigzag circumferential grooves are provided at their opposed alternate curved points with narrow slits.

* * * * *